US007469512B2

(12) United States Patent
Faber et al.

(10) Patent No.: US 7,469,512 B2
(45) Date of Patent: Dec. 30, 2008

(54) FABRICATED WALL SYSTEM

(75) Inventors: Mike Faber, Omaha, NE (US); Chuck Niemeyer, Ashland, NE (US)

(73) Assignee: Board of Regents of the University of Nebraska by and behalf of University of Nebraska Medical Center, Omaha, NE (US)

( * ) Notice: Subject to any disclaimer, the term of this patent is extended or adjusted under 35 U.S.C. 154(b) by 641 days.

(21) Appl. No.: 10/873,722

(22) Filed: Jun. 22, 2004

(65) Prior Publication Data

US 2005/0279033 A1 Dec. 22, 2005

(51) Int. Cl.
*E04C 2/34* (2006.01)

(52) U.S. Cl. ..... 52/481.2; 52/220.2; 52/36.1

(58) Field of Classification Search ..... 52/36.4, 52/36.1, 36.5, 239, 481.2, 764, 780, 220.2, 52/39; 160/135, 351

See application file for complete search history.

(56) References Cited

U.S. PATENT DOCUMENTS 4,660,339 A 4/1987 Paz ..... 52/238
4,866,896 A 9/1989 Shreiner et al. ..... 52/235
5,177,917 A * 1/1993 del Castillo Von Haucke ..... 52/220.7
5,634,300 A * 6/1997 Huebner et al. ..... 52/36.1
5,881,500 A * 3/1999 Latino et al. ..... 52/36.1
5,918,432 A * 7/1999 Mahone et al. ..... 52/220.2
6,115,978 A * 9/2000 Bastian et al. ..... 52/243.1
6,138,583 A 10/2000 Mahone et al. ..... 108/108
6,152,048 A * 11/2000 Vander Park ..... 108/50.02
6,267,064 B1 * 7/2001 Ostertag et al. ..... 108/50.02
7,210,270 B1 * 5/2007 King et al. ..... 52/239
2002/0112411 A1 * 8/2002 Gravel et al. ..... 52/36.1

* cited by examiner

*Primary Examiner*—Richard E Chilcot, Jr.
*Assistant Examiner*—Anthony N Bartosik
(74) *Attorney, Agent, or Firm*—Suiter Swantz pc llo

(57) ABSTRACT

A fabricated wall system employs a plurality of modular wall sections that may be coupled to laboratory benches, cabinets or the like, within the laboratory environment. Each modular wall section comprises a frame including an upper frame portion having one or more slots formed therein for receiving demising panels. The demising panels provide a wall surface within the upper frame portion for demising or separating the laboratory environment into distinct areas. The lower frame portion includes a slot for receiving demising panels removed from the upper frame portions, thereby providing for self-storage of the panels behind the laboratory bench.

18 Claims, 7 Drawing Sheets

FABRICATED WALL SYSTEM

BACKGROUND OF THE INVENTION

The present invention is generally directed to interchangeable fabricated wall systems, and more particularly, to a fabricated wall system for a laboratory environment, or the like, having interchangeable wall sections for dividing an environment, specifically a laboratory, into discrete work areas.

Laboratory space, once designed and built, is difficult to rearrange or remodel without interrupting research being conducted in the space. Presently, most laboratory environments employ fixed walls and laboratory benches or tables that must be demolished and removed when the laboratory is rearranged, such as when the type or distribution of research being conducted in the laboratory changes. Such demolition, and any construction that follows, usually interferes with research being conducted in the laboratory. This interruption may continue for weeks or even months depending on the complexity of the rearrangement or renovation, resulting in unacceptable delay.

Temporary wall systems such as "cubical" wall systems are known to the art and are commonly used in ordinary office environments. These systems can also be used in a laboratory environment. However, depending on the type of research being conducted, it may be necessary to reconfigure the individual laboratory benches. For example, if caustic or radioactive materials are being used, the cubical walls may need to be comprised of a different material; or furthermore, entire sections of the walls may need to be removed completely to provide additional workspace. Therefore, it would be beneficial if users could rearrange their individual laboratory benches without having to rearrange the entire "cubical" wall system. Existing temporary wall systems do not accommodate these needs.

Consequently, it would be desirable to provide a fabricated wall system comprised of a modular laboratory bench separated by wall sections. It would furthermore be desirable for the wall sections to be comprised of removable panels, thereby allowing the laboratory to be reconfigured with ease.

SUMMARY OF THE INVENTION

Accordingly, the present invention is directed to a fabricated wall system, particularly suited for use in a laboratory environment. In exemplary embodiments of the invention, the fabricated wall system employs modular wall sections that may be coupled to laboratory benches, cabinets, or the like, within the laboratory environment. Each modular wall section comprises a frame including an upper frame portion and a lower frame portion. The upper frame portion includes one or more slots formed therein for receiving demising panels. The demising panels provide a wall surface within the upper frame portion for demising or separating the laboratory environment into distinct areas (e.g., for separating one laboratory bench from a second laboratory bench, an isle, or the like). The lower frame portion includes a slot for receiving demising panels removed from the upper frame portions, thereby providing for self-storage of the panels behind the laboratory bench, cabinet, or the like.

It is to be understood that both the forgoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DESCRIPTION OF THE INVENTION

Figure 1:
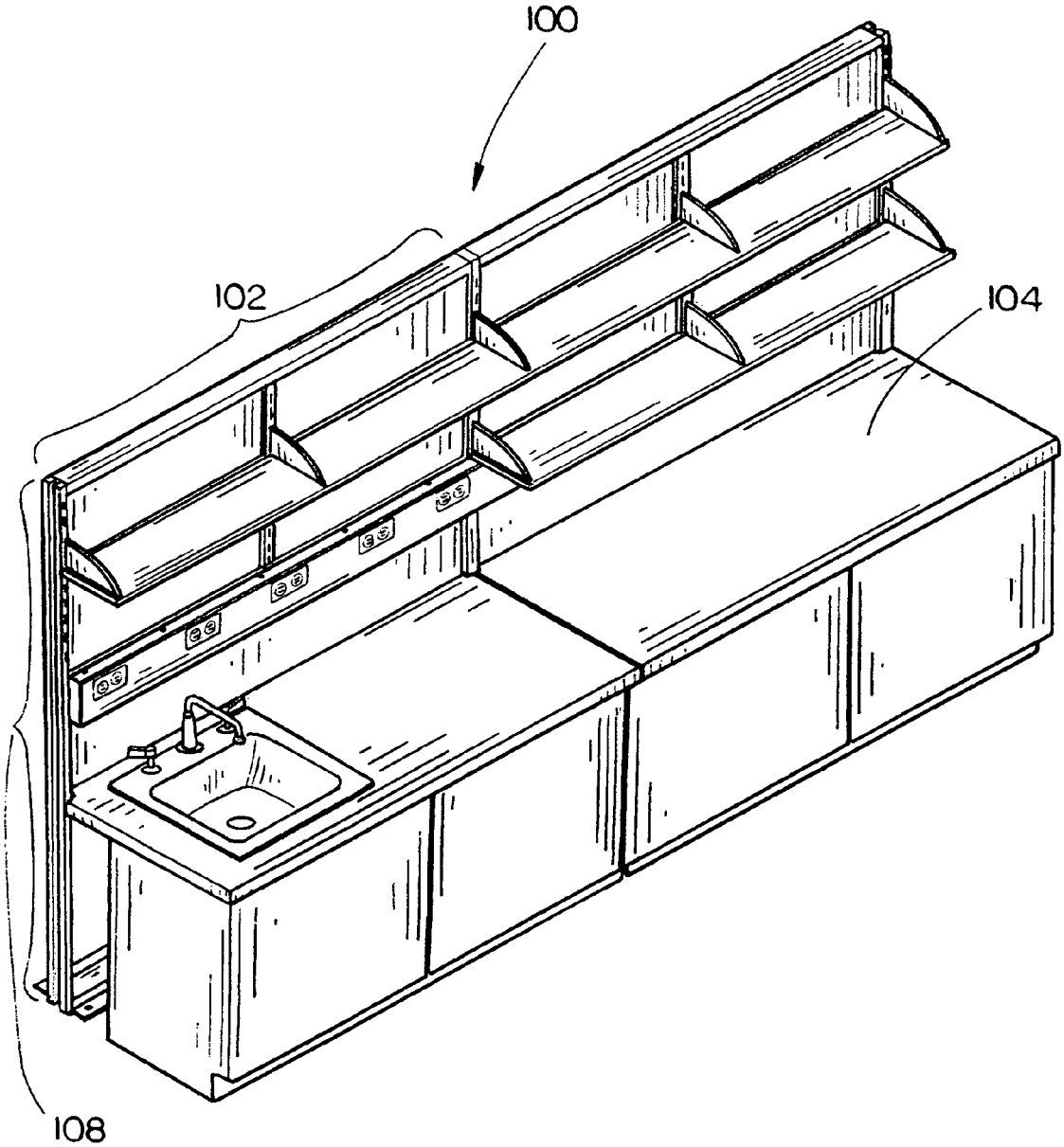
FIG. 1 is an isometric view illustrating a fabricated wall system in accordance with an exemplary embodiment of the present invention.
Figure 2:
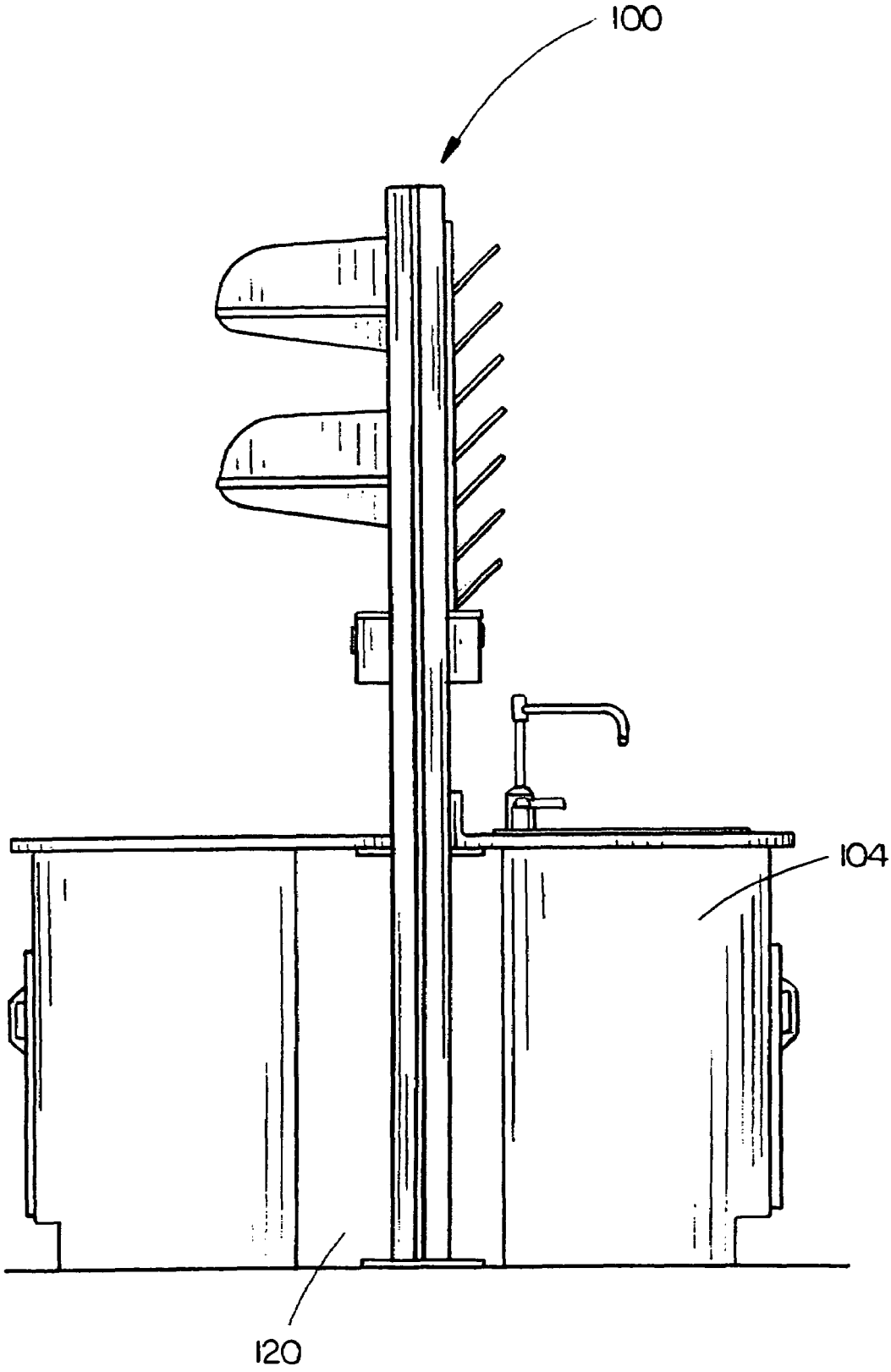
FIG. 2 is a side elevation view of the fabricated wall system shown in FIG. 1, wherein the fabricated wall system includes a modular wall section coupled to laboratory benches or cabinets, an electrical outlet assembly, shelving, and plumbing in accordance with an exemplary embodiment of the present invention.
Figure 3:
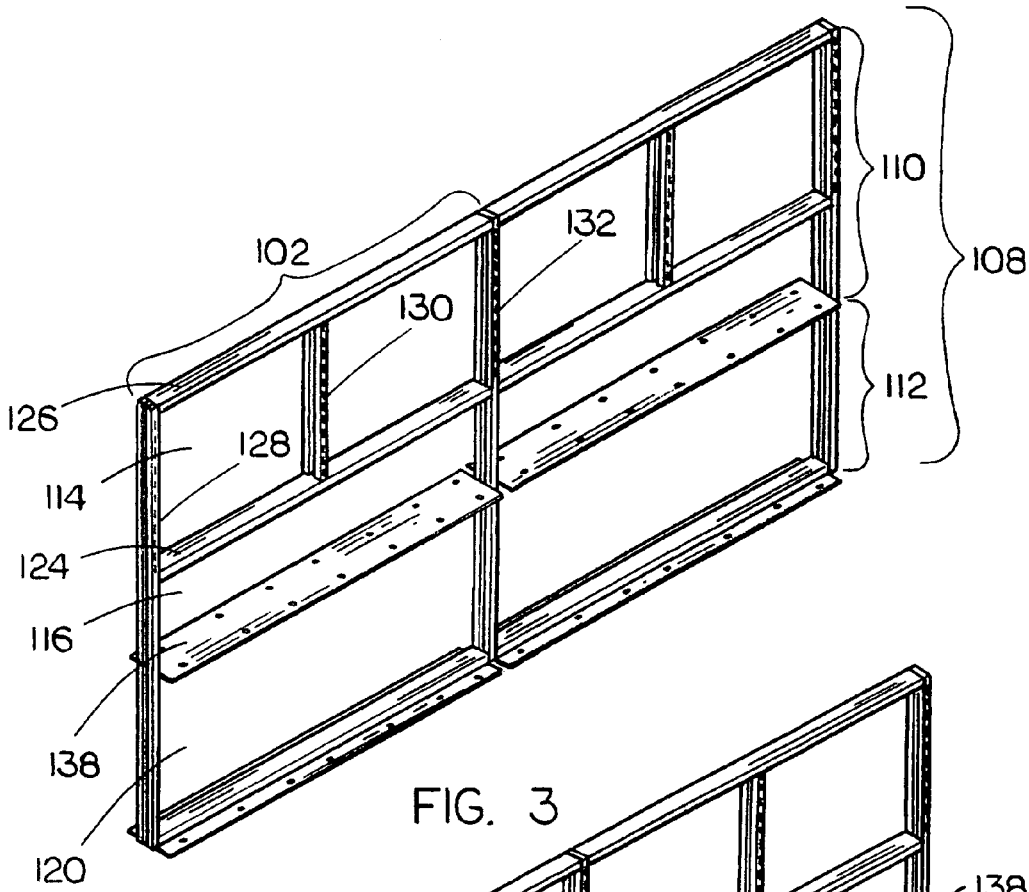
FIG. 3 is an isometric view illustrating an exemplary frame of a modular wall section of the fabricated wall system shown in FIG. 1.
Figure 4:
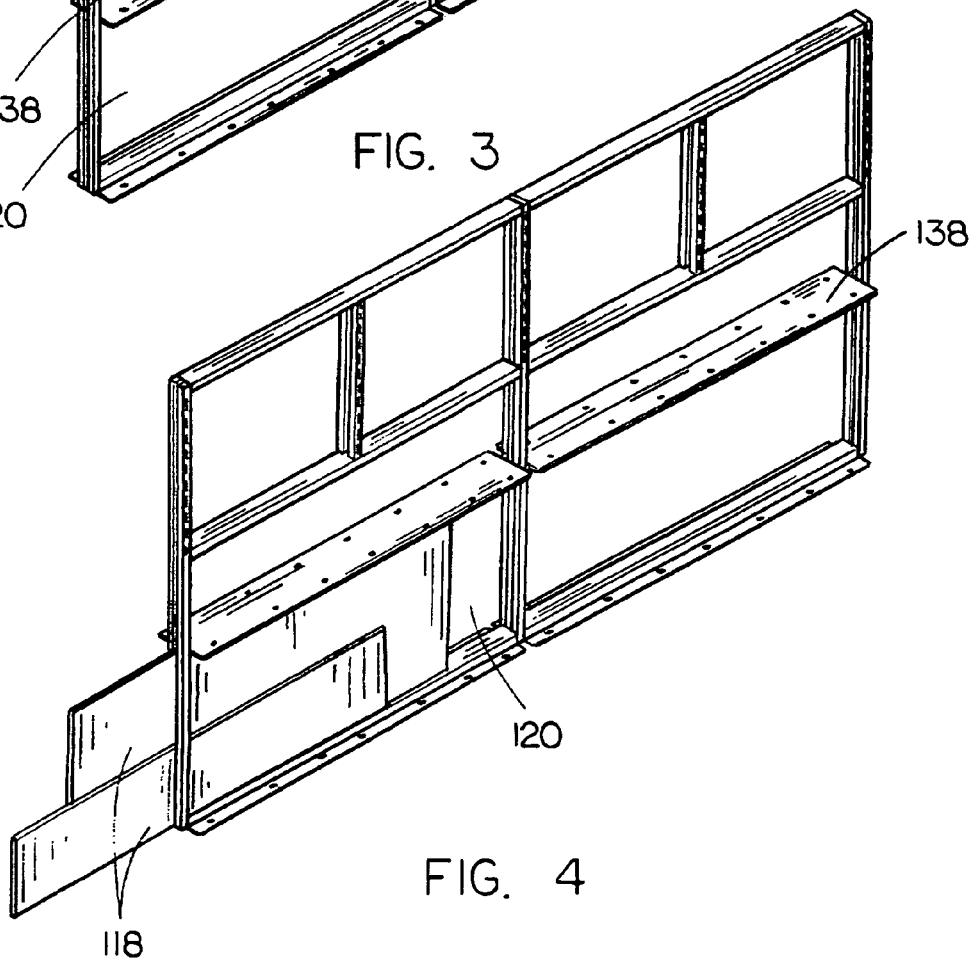
FIG. 4 is an isometric view of the frame illustrated in FIG. 3, illustrating storage of demising panels within the lower frame portion.
Figure 5:
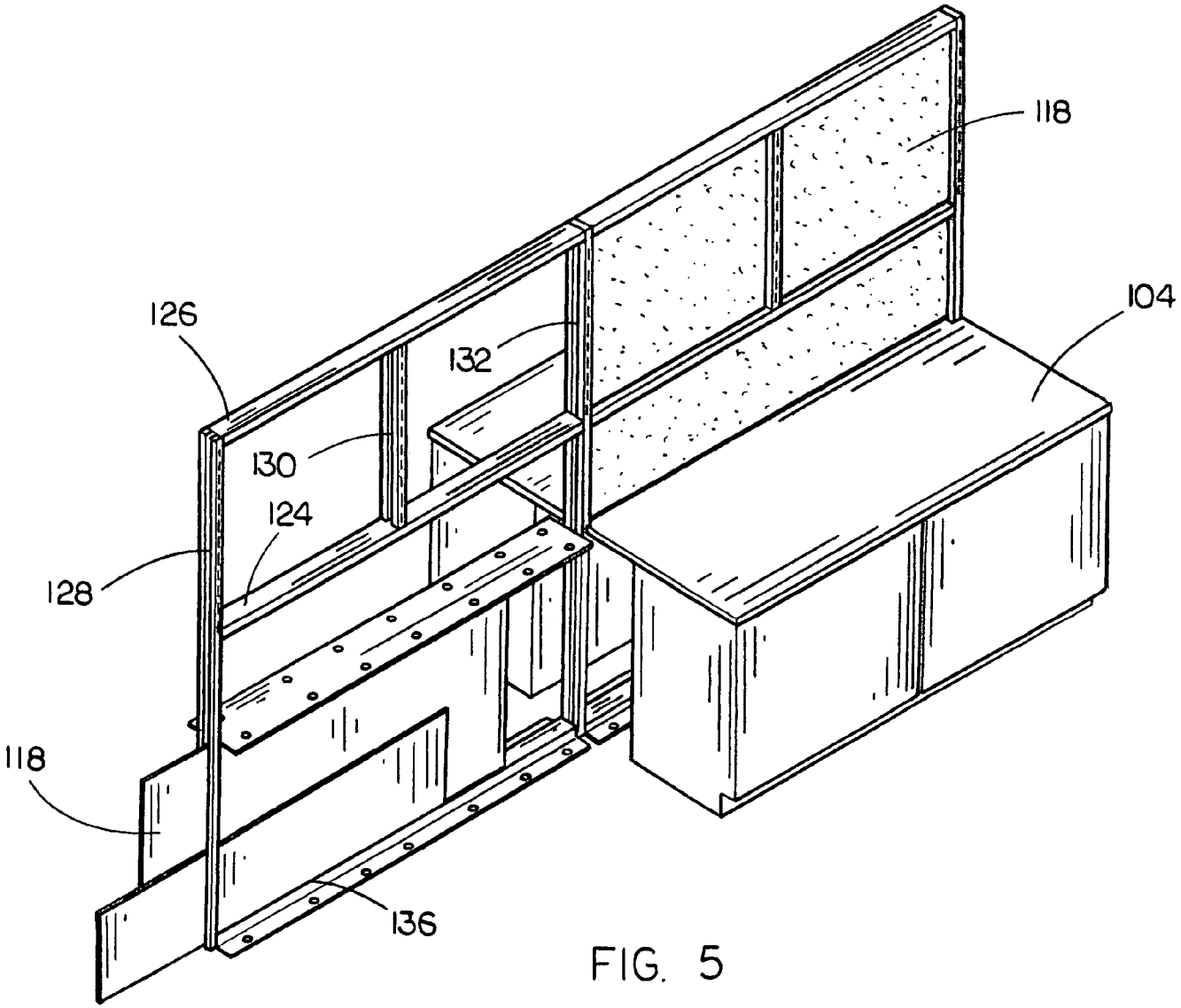
FIG. 5 is an isometric view illustrating assembly of the fabricated wall system shown in FIG. 1, in accordance with an exemplary embodiment of the present invention.
Figure 6:
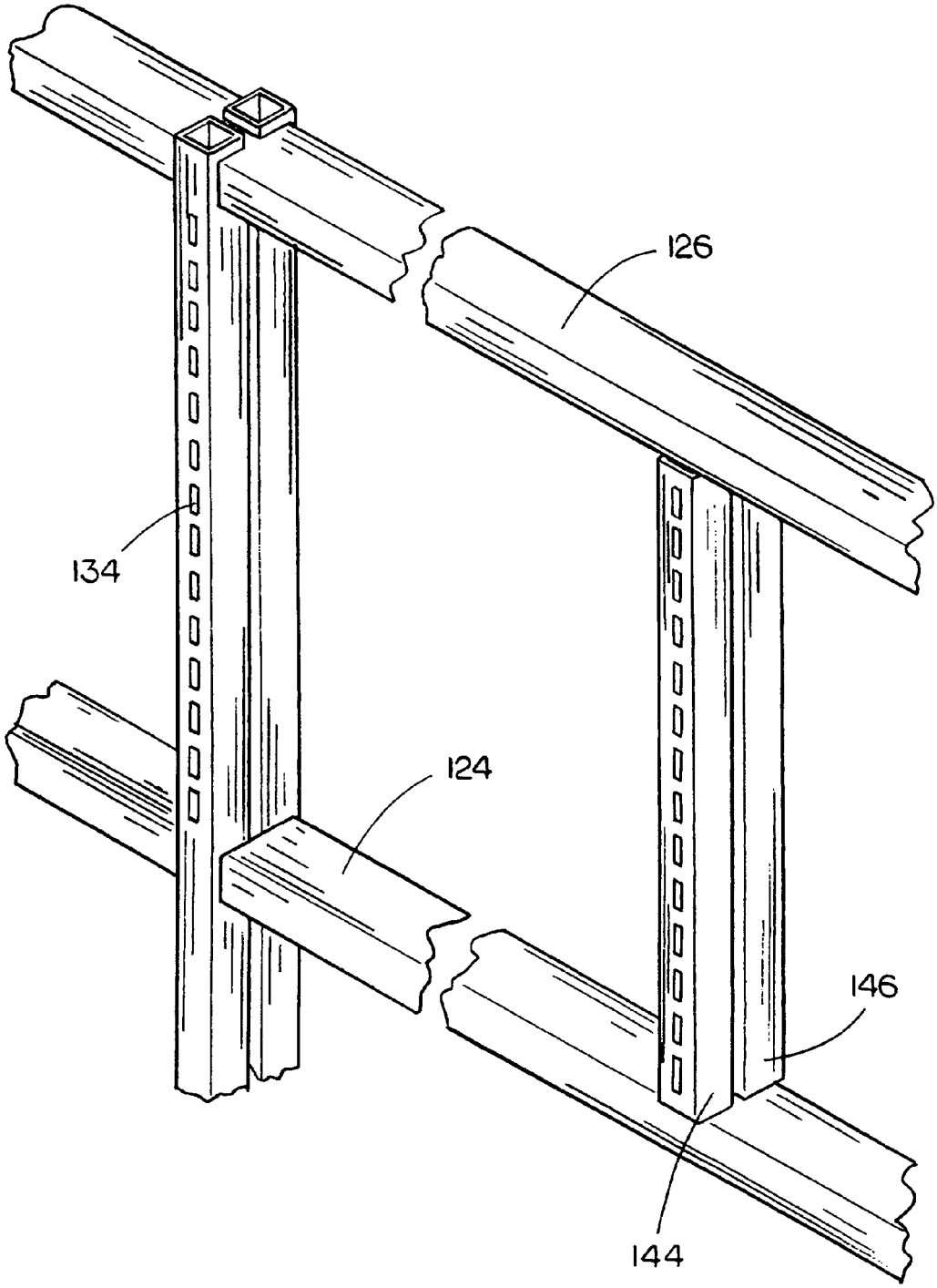
FIG. 6 is an isometric view of the upper frame portion of the frame shown in FIG. 3, further illustrating the vertical and horizontal support members.

Reference will now be made in detail to the presently preferred embodiments of the invention, examples of which are illustrated in the accompanying drawings.

Referring now to FIGS. 1 through 8, a fabricated wall system 100 in accordance with an exemplary embodiment of the present invention is described. As illustrated, the fabricated wall system 100 comprises a plurality of modular wall sections 102 that may be coupled to laboratory benches, cabinets, or the like, 104 within the laboratory environment. Each modular wall section 102 comprises a frame 108 including an upper frame portion 110 and a lower frame portion 112. In accordance with the present invention, the upper frame portion 110 includes one or more slots (an upper slot 114 and a lower slot 116 are illustrated) formed therein for receiving various demising panels 118. The demising panels 118 form a wall surface within the upper frame portion 110 for demising or separating the laboratory environment into distinct areas (e.g., for separating one laboratory bench from a second laboratory bench, an isle, or the like). The lower frame portion 112 includes a storage slot 120 for receiving demising panels 118 removed from the slots 114 & 116 in the upper frame portion 110, thereby providing for self-storage of the panels 118 behind the laboratory bench, cabinet, or the like 104. It is contemplated that the demising panels 118 may be made of any material such as wood, glass, corkboard, plastic or the like. In other embodiments the demising panels 118 may be covered with sound dampening material to increase privacy.

In the exemplary embodiment illustrated, the frame 108 may be comprised of a plurality of horizontal support members 122, 124 & 126, and a plurality of vertical support members 128, 130 & 132, which are joined together as necessary to form the desired frame. Tracks 134 are made in the vertical support members 128, 130 & 132 allowing shelves to be installed on the upper frame portion 110 of the modular wall sections 102. It is contemplated that the number and height of horizontal and vertical support members to form the frame may vary without departing from the scope and spirit of the present invention. Further, horizontal and vertical support members may be made of a variety of materials such as plastic, aluminum, steel, or the like, and be configured with various cross-sectional shapes including a rectangular shaped cross-section, square shaped cross-section, or the like. In addition, the vertical support members 128, 130 & 132 may be manufactured with receptacles allowing electrical outlets, plumbing and other desired features to be installed onto the modular wall section 100.

Figure 8:
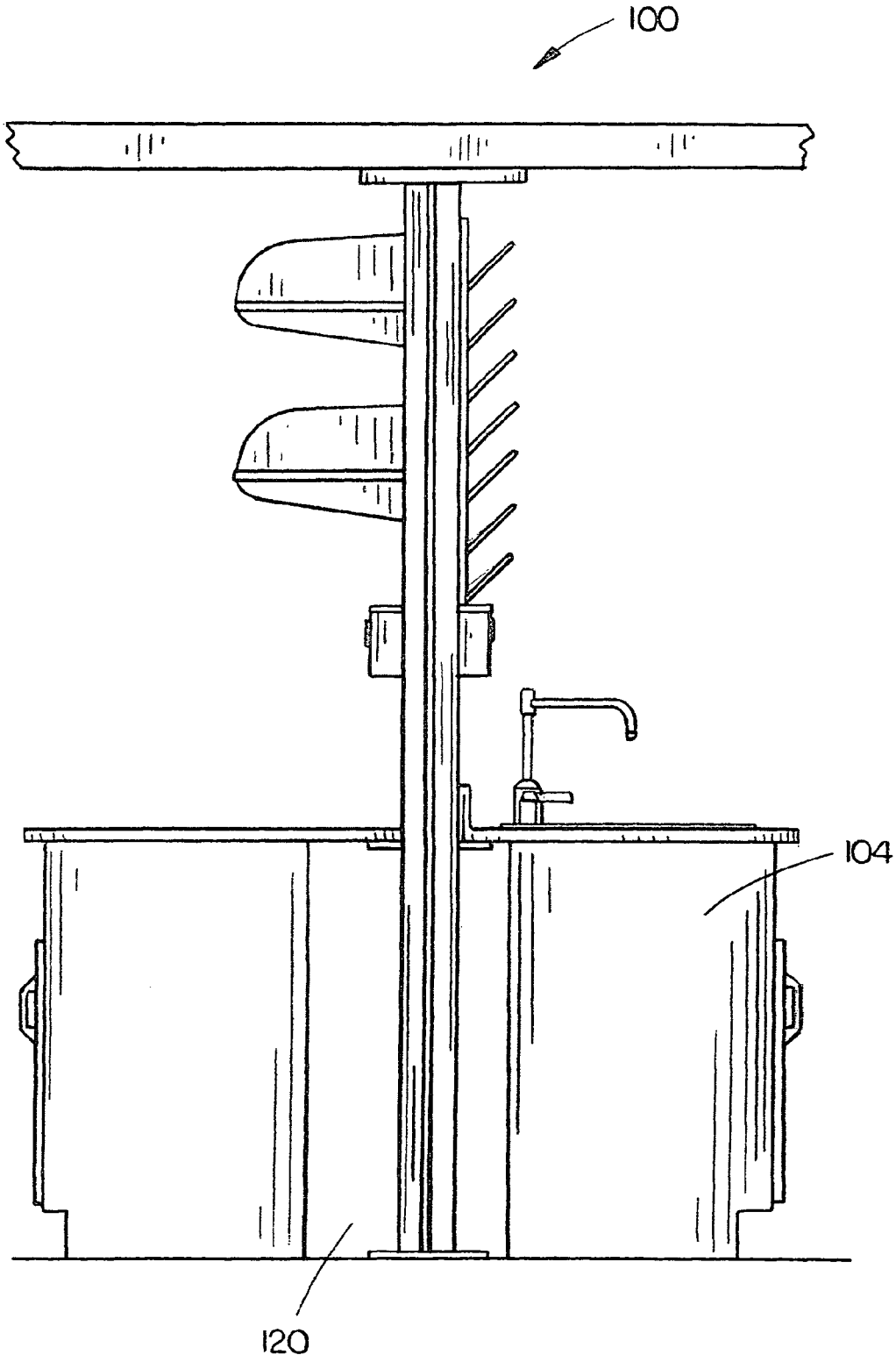
FIG. 8 is a side view of the fabricated wall system showing attachment at both a floor surface and a ceiling.

As shown by the exemplary embodiment, the frame 108 is further comprised of a base member 136 and a bench attachment member 138, both of which are disposed generally horizontally in the frame. The bench attachment member 138 includes a fastener 148 for securing the frame 108 to a laboratory bench, cabinet, or the like 104. The base member 136 is coupled to a flange 140. The flange 140 contains multiple holes 142 capable of receiving fasteners that allow the frame 108 to be secured to either a floor surface or a ceiling of the room in which the fabricated wall system 100 is being used. Hence, the base member 136 may be positioned at the bottom side of the frame 108 for attachment to the floor surface, or in the alternative, the base member 136 may be positioned at the top side of the frame 108 for attachment to the ceiling. Furthermore, the frame 108 may be comprised of a base member 136 at both the top and the bottom of the frame 108 so that attachment with both the floor surface and the ceiling may be accomplished, as shown in FIG. 8. Also, because floors and ceilings can be made of different materials, and because the frame 108 will exert different forces on the flange 140 when attached to the ceiling as opposed to the floor, it is further contemplated that the base member 136, the flange 140, and the fasteners may be comprised of different materials and be of varying dimensions to ensure that the fabricated wall system 100 is adequately stabilized.

Figure 7:
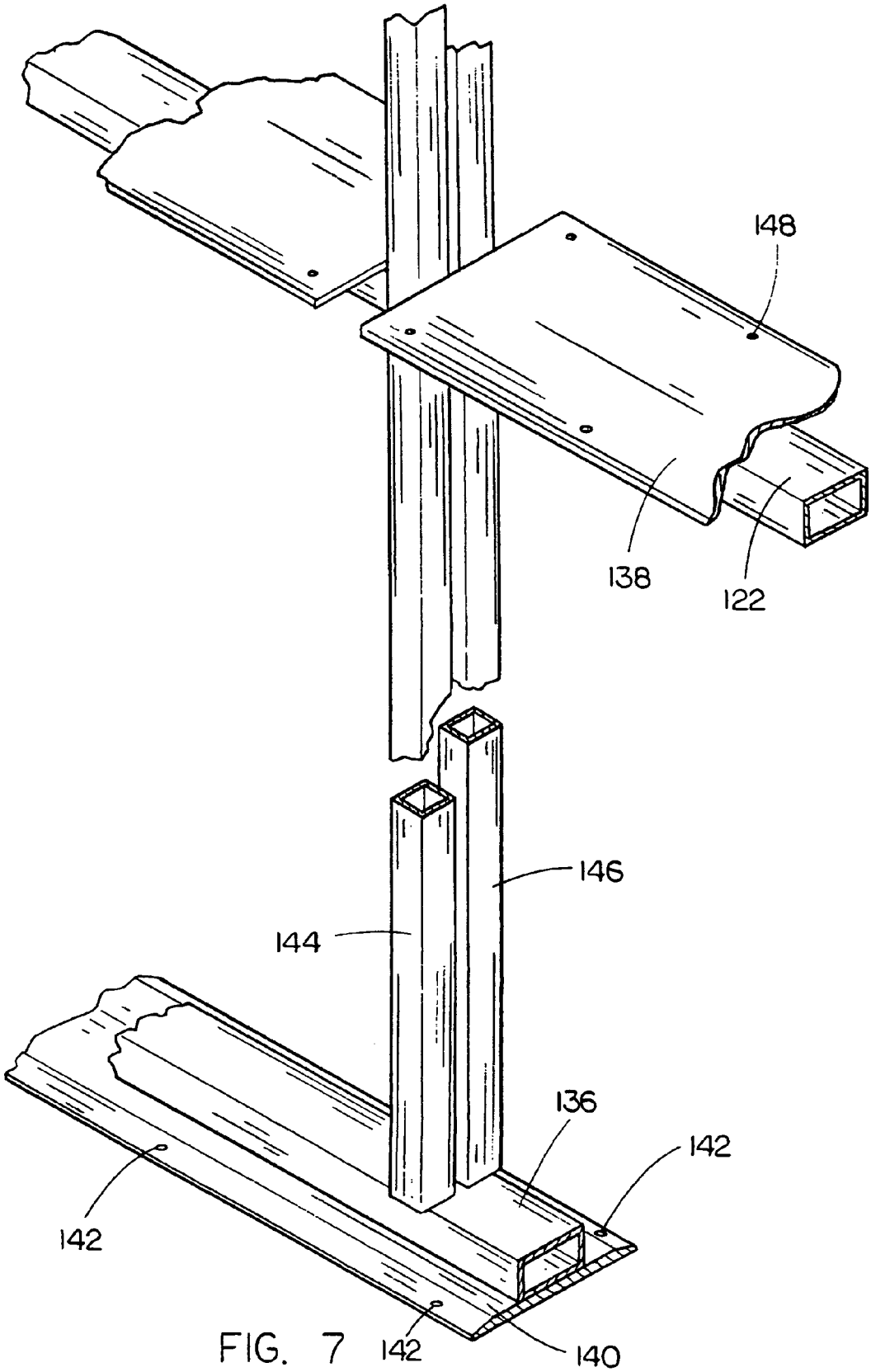
FIG. 7 is an isometric view of the lower frame portion of the frame shown in FIGS. 3 and 4, further illustrating the base member, vertical support member, and bench attachment member.

Referring to FIGS. 7 and 8, the flange 140 is a flat elongated footing that may be wider than the base member 136 and may include multiple holes 142 so that the flange 140 may be secured to the floor surface or ceiling via fasteners. The base member 136 and the flange 140 may be formed from a variety of materials such as plastic, aluminum, steel, or the like. Fasteners include bolts, screw, pins, nails, or the like. In addition to providing a means for anchoring the frame 108 to the floor surface or the ceiling, the base member 136 provides a floor for the storage slot 120 and a means of coupling the vertical support members 128, 130 & 132 to the base as well keeping such members aligned with one another. The base member 136 may be coupled to the flange 140 via a variety of devices including bolts, screws, pins, nails, or the like.

Like the base member 136, the plurality of horizontal support members 122, 124 & 126 may assist the vertical support members 128, 130 & 132 in keeping their alignment. In an exemplary embodiment, each vertical support member may couple to the horizontal support members through the use of a variety of devices such as bolts, screws, pins, nails, or the like. In addition, the horizontal support members 122, 124 & 126 may be equipped with rectangular slots slightly wider than the vertical support members so that the vertical support members can couple to the horizontal support members by simply sliding into the slots. A horizontal support member may be positioned at the top of the fabricated wall to provide stability. It is further contemplated that any number of horizontal support members may be positioned throughout the fabricated wall without departing from the scope and spirit of the present invention.

As described above, the demising panels 118 may be inserted into both the storage slot 120 and the upper frame 110. Insertion into the storage slot 120 is accomplished by sliding the demising panel 118 between the two vertical posts 144 and 146 of the vertical support members 128, 130 & 132 and over the top portion of the base member 136. Likewise, insertion into the upper frame 110 is accomplished by sliding the demising panels 118 between the two vertical posts 144 and 146 of a vertical support member 128, 130 or 132 and between two horizontal support members chosen from 122, 124 & 126.

The fabricated wall system 100 provides a means by which users can construct and deconstruct walls in a matter of minutes. Without the present invention, users who need more workspace or want more privacy are forced to stop their projects and transport all of their equipment to a different location. While this may be a huge nuisance, a bigger problem arises when the equipment is not transportable. Hence, the fabricated wall system 100 of the present invention is a useful improvement on the temporary wall systems of the prior art.

What is claimed is:

1. A modular wall section, comprising:

a frame including an upper frame portion and a lower frame portion, the upper frame portion having a first slot disposed therein and the lower frame portion having a second slot disposed therein;

a panel for being received in the first slot to form a wall surface within the upper frame portion; and at least a first vertical frame member, a second vertical frame member, a top horizontal frame member, an intermediate horizontal frame member, a bench attachment member, and a base member, the top horizontal frame member, the intermediate horizontal frame member, the bench attachment member, and the base member extending between the first and second vertical frame members, wherein the panel is configured to be received in the first slot of the upper frame portion or the second slot of the lower frame portion for storage of the panel, the upper frame portion further comprises a third slot for receiving a second panel, the second panel further forming the wall surface within the upper frame portion and configured to be received in the third slot of the upper frame portion or the second slot of the lower frame portion for storage of the second panel, and the first vertical member and the second vertical member form the first slot and the third slot between one of the top horizontal frame member and the intermediate horizontal frame member or the intermediate horizontal frame member and the bench attachment member, and the first vertical member and the second vertical member form the second slot between the bench attachment member and the base member, so that the panel is received through one of the first slot or the third slot between one of the top horizontal frame member and the intermediate horizontal frame member or the intermediate horizontal frame member and the bench attachment member.

2. The modular wall section as claimed in claim 1, wherein the base member is disposed generally horizontally in the frame and further includes a flange for receiving a fastener for securing the frame to a floor surface or a ceiling.

3. The modular wall section as claimed in claim 1, wherein the bench attachment member is disposed generally horizontally in the frame and is configured to receive a fastener for securing the frame to a laboratory bench.

4. The modular wall section as claimed in claim 1, further comprising a third vertical member disposed between the top horizontal frame member and the intermediate horizontal frame member, the third vertical member forming at least a portion of at least one of the first slot or the third slot.

5. The modular wall section as claimed in claim 4, wherein the first vertical member comprises a first vertical member half and a second vertical member half, the first vertical member half and the second vertical member half orientatable in substantially parallel relation to each other to form a gap there between for forming a slot.

6. The modular wall section as claimed in claim 5, wherein at least a portion of at least one of the first vertical member half or the second vertical member half comprises a plurality of vertically aligned apertures for supporting a shelf.

7. A modular wall system for a laboratory, comprising:

a plurality of modular wall sections, each modular wall section including:

a frame including an upper frame portion and a lower frame portion, the upper frame portion having at least a first slot disposed therein and the lower frame portion having a second slot disposed therein;

at least one panel for being received in the first slot to form a wall surface within the upper frame portion; and at least a first vertical frame member, a second vertical frame member, a top horizontal frame member an intermediate horizontal frame member, a bench attachment member, and a base member, the top horizontal frame member, the intermediate horizontal frame member, the bench attachment member, and the base member extending between the first and second vertical frame members, wherein the at least one panel is configured to be received in the first slot of the upper frame portion or the second slot of the lower frame portion for storage of the panel, the upper frame portion further comprises a third slot for receiving a second panel, the second panel further forming the wall surface within the upper frame portion, and wherein, the second panel is configured to be received in the third slot of the upper frame portion or in the second slot of the lower frame portion for storage of the second panel, and the first vertical member and the second vertical member form the first slot and the third slot between one of the top horizontal frame member and the intermediate horizontal frame member or the intermediate horizontal frame member and the bench attachment member, and the first vertical member and the second vertical member form the second slot between the bench attachment member and the base member, so that the panel is received through one of the first slot or the third slot between one of the top horizontal frame member and the intermediate horizontal frame member or the intermediate horizontal frame member and the bench attachment member.

8. The modular wall system as claimed in claim 7, wherein a base member is disposed generally horizontally in the frame and includes a flange for receiving a fastener for securing the frame to a floor surface or a ceiling.

9. The modular wall system as claimed in claim 7, wherein the bench attachment member is disposed generally horizontally in the frame and is configured to receive a fastener for securing the frame to a laboratory bench.

10. The modular wall as claimed in claim 7, further comprising a third vertical member disposed between the top horizontal frame member and the intermediate horizontal frame member, the third vertical member forming at least a portion of at least one of the first slot or the third slot.

11. The modular wall system as claimed in claim 10, wherein the first vertical member comprises a first vertical member half and a second vertical member half, the first vertical member half and the second vertical member half orientatable in substantially parallel relation to each other to form a gap there between for forming a slot.

12. The modular wall system as claimed in claim 11, wherein at least a portion of at least one of the first vertical member half or the second vertical member half comprises a plurality of vertically aligned apertures for supporting a shelf.

13. A modular laboratory, comprising:

a laboratory bench;

a modular wall section coupled to the laboratory bench and including;

a frame including an upper frame portion extending above the bench and a lower frame portion disposed behind the laboratory bench, the upper frame portion having at least a first slot disposed therein, and the lower frame portion having a second slot disposed therein;

at least one panel for being received in the first slot to form a wall surface within the upper frame portion above the laboratory bench; and at least a first vertical frame member, a second vertical frame member, a top horizontal frame member an intermediate horizontal frame member, a bench attachment member, and a base member, the top horizontal frame member, the intermediate horizontal frame member, the bench attachment member, and the base member extending between the first and second vertical frame members;

wherein the panel is configured to be received in the first slot of the upper frame portion or the second slot of the lower frame portion for storage of the panel behind the laboratory bench, the upper frame portion further includes a third slot for receiving a second panel, the second panel further forming the wall surface within the upper frame portion, the second panel being configured to be received in the third slot of the upper frame portion or in the second slot of the lower frame portion for storage of the second panel, and the first vertical member and the second vertical member form the first slot and the third slot between one of the top horizontal frame member and the intermediate horizontal frame member or the intermediate horizontal frame member and the bench attachment member, and the first vertical member and the second vertical member form the second slot between the bench attachment member and the base member, so that the panel is received through one of the first slot or the third slot between one of the top horizontal frame member and the intermediate horizontal frame member or the intermediate horizontal frame member and the bench attachment member.

14. The modular laboratory as claimed in claim 13, wherein the base member is disposed generally horizontally in the frame and further includes a flange for receiving a fastener for securing the frame to a floor surface or a ceiling.

15. The modular wall as claimed in claim 13, wherein the bench attachment member is disposed generally horizontally in the frame and is configured to receive a fastener for securing the frame to a laboratory bench.

16. The modular laboratory as claimed in claim 13, further comprising a third vertical member disposed between the top horizontal frame member and the intermediate horizontal frame member, the third vertical member forming at least a portion of at least one of the first slot or the third slot.

17. The modular laboratory as claimed in claim 16, wherein the first vertical member comprises a first vertical member half and a second vertical member half, the first vertical member half and the second vertical member half orientatable in substantially parallel relation to each other to form a gap there between for forming a slot.

18. The modular laboratory as claimed in claim 17, wherein at least a portion of at least one of the first vertical member half and the second vertical member half comprises a plurality of vertically aligned apertures for supporting a shelf.

* * * * *